US010472931B1

(12) United States Patent
Keller

(10) Patent No.: US 10,472,931 B1
(45) Date of Patent: Nov. 12, 2019

(54) METHOD FOR REMOVAL OF FLEXIBLE LINERS FROM BOREHOLES

(71) Applicant: Carl E. Keller, Santa Fe, NM (US)

(72) Inventor: Carl E. Keller, Santa Fe, NM (US)

( * ) Notice: Subject to any disclaimer, the term of this patent is extended or adjusted under 35 U.S.C. 154(b) by 49 days.

(21) Appl. No.: 15/960,669

(22) Filed: Apr. 24, 2018

Related U.S. Application Data

(63) Continuation-in-part of application No. 15/190,010, filed on Jun. 22, 2016, now Pat. No. 10,030,486.

(60) Provisional application No. 62/182,935, filed on Jun. 22, 2015.

(51) Int. Cl.
*E21B 43/10* (2006.01)
*E21B 41/00* (2006.01)
*E21B 34/06* (2006.01)

(52) U.S. Cl.
CPC ..... *E21B 41/00* (2013.01); *E21B 34/06* (2013.01); *E21B 43/10* (2013.01)

(58) Field of Classification Search
CPC ..... F16L 55/1651; F16L 55/165; E21B 23/01; E21B 43/10
USPC ..... 405/184.1
See application file for complete search history.

(56) References Cited

U.S. PATENT DOCUMENTS 5,794,663 A * 8/1998 Kiest, Jr. ..... B29C 63/36 138/97
5,816,293 A * 10/1998 Kiest, Jr. ..... B29C 63/0095 138/98
7,670,086 B2 * 3/2010 Kiest, Jr. ..... E02D 29/12 404/25
10,030,486 B1 * 7/2018 Keller ..... E21B 43/103
2019/0186672 A1 * 6/2019 Coutts ..... F16L 55/1651

* cited by examiner

*Primary Examiner* — Kenneth L Thompson
(74) *Attorney, Agent, or Firm* — Rod D. Baker

(57) ABSTRACT

A system and method for performing a flexible liner inversion out from a low-permeability borehole. A flexible liner may be installed by eversion down a subterranean borehole to selectively seal the borehole. Such a liner may be removed from the borehole by inverting it up the borehole. Water is added into the borehole beneath the lowest end of the liner, to permit or facilitate inversion of the liner. Water is allowed to flow from the interior of the liner to the borehole space beneath the liner, thereby raising the pressure in the unsealed borehole beneath the liner, and thereby allowing the liner to be further inverted upward. By allowing water to flow from the liner interior to a borehole volume beneath the liner, the need for a long vent or pumping tube is avoided.

22 Claims, 11 Drawing Sheets

METHOD FOR REMOVAL OF FLEXIBLE LINERS FROM BOREHOLES

CROSS-REFERENCE TO RELATED APPLICATIONS

This application is a continuation-in-part of my co-pending U.S. patent application Ser. No. 15/190,010 entitled "Method for Installation or Removal of Flexible Liners from Boreholes," filed 22 Jun. 2016, which claimed the benefit of the filing of U.S. Provisional Patent Application Ser. No. 62/182,935 entitled "Method for Removal of Flexible Liners from Boreholes," filed on 22 Jun. 2015. The entire disclosures of both these previous applications are incorporated herein by reference.

BACKGROUND OF THE INVENTION

Field of the Invention

This invention relates generally to using flexible liners for lining subterranean boreholes, and more specifically to a method for performing a flexible liner inversion from a low-permeability subterranean borehole.

Background Art

Flexible liners have been installed in pipes and subsurface boreholes by the process of eversion for more than 20 years. U.S. Pat. No. 7,896,578, for example, discloses an emplacement of a carbon felt by the process of liner eversion. In known processes for liner eversion, if the bottom portion of a subsurface borehole is in a very low conductivity geologic formation, a tube called a pump tube must be lowered into the borehole to remove the water from beneath the liner while the liner descends by eversion. Otherwise, the liner eversion stops short of the bottom of the borehole, as ambient water trapped in the borehole prevents complete eversion, because the everting liner cannot force the ambient water from the borehole into the surrounding geologic formation.

Liners installed by eversion are normally removed or withdrawn from a borehole by a process of liner inversion, essentially the reverse of eversion. However, withdrawal by liner inversion can pose significant challenges, especially in boreholes whose surrounding geologic formation is of low conductivity.

After a liner has been everted into place (with the assistance of a pump tube), the pump tube can be removed to the surface by at least partially collapsing the liner, withdrawing the pump tube, and then re-inflating the liner with water or other fluids. However, once the pump tube has been removed, it is usually not possible to re-install the pump tube to add water beneath the liner, due to the extreme difficulty in inserting the pump tube between the liner and the borehole wall against which the liner is emplaced. The pump tube cannot be re-inserted in the borehole between the liner and the borehole wall due to, among other things, friction and breakouts in the borehole wall acting to block the tube's descent. This poses a serious problem when it is desired to invert an installed liner to retrieve it from a borehole in a formation is of low conductivity.

If it is attempted to invert the liner from a borehole in a geologic formation with little conductivity, the liner cannot be inverted without pulling a partial vacuum beneath the liner (between the bottom of the liner and the bottom of the borehole) as it inverts. The resulting tension on the liner to effect the inversion is usually greater than the system can withstand, and the liner will be torn apart. The basic problem is that the low conductivity formation does not allow water to flow back from the formation and into the borehole beneath the inverting liner. Devices such as lay-flat hoses have been emplaced in a borehole to allow water addition beneath the everted end of a liner to aid the liner's inversion, but if the flat hose is kinked, as often occurs, the inversion fails (e.g., when water cannot be pumped down the tube). Also, a lay-flat hose may compromise the sealing of the borehole by the liner, and the water addition via a hose can cause a buckling of the liner during the inversion.

A major advantage of the present invention is to allow a liner to be inverted from the bottom of the borehole in a formation of low permeability without the need to add water through a long tube extending from the surface to beneath the bottom end of the liner. An additional feature of this design allows the venting of air trapped in the liner without the long vent tube of the co-pending application. The present system and method does not replace the ability of the invention of the co-pending application to withdraw water from beneath the liner as the liner is everted into place. Rather there is disclosed hereby an improved supplemental method and system for inverting a liner to extract it from a borehole.

SUMMARY OF THE INVENTION

There is initially disclosed hereby a method and system for introducing water into the borehole beneath a liner as it is being inverted from a borehole. A port is provided in a segment of the liner, through which port a fluid (normally water) is permitted to flow from within the interior of the liner toward and into a lower borehole volume beneath the inverting end of the liner. A pressure relief valve, in fluid communication with the port, opens and closes automatically when a pressure differential between the fluid pressure within the liner and the fluid pressure in the lower borehole volume exceeds, or drops below, respectively, a predetermined and preselected threshold value. By the system and method, the fluid pressure in the lower borehole volume, below the lowermost inverting end of the liner, can be increased as needed to prevent an undesirably low pressure from developing in the lower borehole volume, which low pressure can impede or prevent the inversion of the liner up the borehole. The opening and closing of the pressure relief valve, and thus the flow of fluid from the liner interior to the lower borehole volume, can be regulated by adjusting the tension in the tether that is pulling the liner up the borehole.

BRIEF DESCRIPTION OF THE DRAWINGS

The accompanying drawings, which are incorporated into and form a part of the specification, illustrate embodiments of the present invention and, together with the description, serve to explain the principles of the invention. The drawings are only illustrating preferred embodiments of the invention, and are not to be construed as limiting the invention. Further, various elements depicted in the various views are not necessarily to scale relative to one another. In the drawings.

DESCRIPTION OF PREFERRED EMBODIMENTS

There is disclosed a method and apparatus for withdrawing by inversion a flexible liner previously installed into a borehole, such as a subterranean borehole. The method and apparatus are especially useful in allowing the inversion of flexible liners from boreholes in subsurface geologies with very low conductivity, which do not allow water to flow into the borehole beneath the inverting liner.

Figure 1:
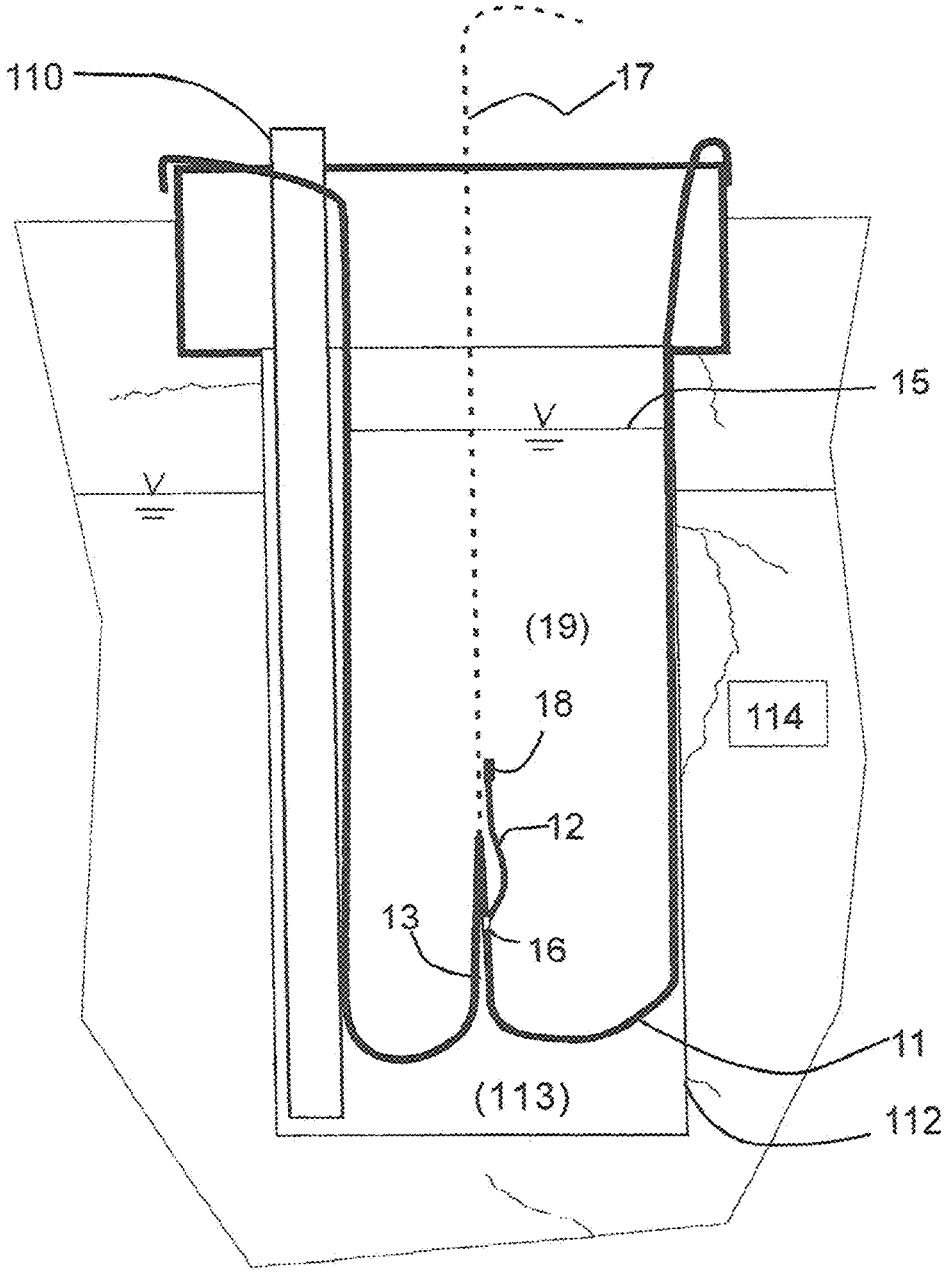
FIG. 1 is a side sectional view of a known flexible liner system in a borehole, illustrating a vent tube design with a check valve in place, with the inverted liner dilated by the water pressure and a pump tube for removal of water beneath the everting liner.

Attention is invited to FIG. 1, which illustrates a method known in the art for the conventional eversion of a flexible liner 11 into a borehole 112. The prior art method ordinarily requires a length of vent tube 12 on the closed end of the liner 11 (i.e., the lower closed end which everts during liner installation). The vent tube 12 allows air entrapped exterior to the liner, but within the inverted liner pocket 13 defined at the outside of the closed end of the liner, to escape as the closed end of the liner 11 descends beneath the water level 15 within the liner. Otherwise, the air thus entrapped within the outside pocket 13 can dilate the liner 11 (particularly at its closed everting end) until the descent of the liner 11 is substantially impeded. Known techniques for everting a liner into a borehole are generally described in my U.S. Pat. Nos. 7,281,422 and 7,896,578, incorporated by reference herein.

Continued reference is made to FIG. 1, depicting the ordinary geometry of the air vent system featuring long vent tube 12. The tether 17 is a cord or cable attached to the closed end of the liner 11, and may be used to raise or lower the closed end of the liner to invert the liner and/or control its eversion. A port 16 is defined in the closed end of the liner 11, and has sealed connection to the vent tube 12. The tube 12 may be attached to the tether 17 so to run upward along a segment of the tether 17, usually for a relatively short distance of about ten feet or less. The vent tube 12 is fitted with at least one check valve 18 to prevent water in the interior 19 of the liner 11 from flowing back down through the vent tube 12 and out the port 16 (thereby causing the liner 11 to deflate and to lose the water level 15 necessary for internal liner pressure to seal the everted liner against the borehole wall).

As seen in FIG. 1, a pump tube 110 is often placed in the borehole 112 prior to the installation of the liner 11 by eversion. Without the pump tube 110, the everting liner 11 to advance down the hole must drive the water 113 in the borehole (beneath the everting end of the liner) into the surrounding geologic formation 114. Because the formation 114 may be of low hydraulic conductivity, the liner 11 descent can be slowed or stopped by water 113 trapped in the borehole space beneath the descending liner 11. The pump tube 110 allows the water 113 beneath the liner 11 to be removed, aiding the eversion of the liner 11 to the bottom of the borehole 112. However, the liner 11 is intended to seal the borehole 112, and so the pump tube 110 must thereafter be removed because it prevents a reliable seal of the liner 11 against the full circumference of the borehole 112 wall.

Removal of the pump tube 110 normally is done by removing some of the water from the interior 19 of the liner 11, causing it to partially collapse. The partially collapsed liner releases the pump tube 110 from being "clamped" between the liner and the borehole wall. After the pump tube 110 has been withdrawn out of the borehole 112, water can again be added to the liner interior 19, causing the liner 11 to re-inflate, and thereby seal against the full circumference of the wall of the borehole 112. With the liner in its inflated and dilated state, sealed against the borehole wall, it thereafter is difficult to invert the liner 11 out of the borehole 112; such removal by inversion requires that water flows from the geologic formation 114 into the borehole 112 as the liner 11 is inverted upwards in the borehole 112. If the formation permeability is too low to allow the water to flow into the portion of the borehole beneath the inverting liner, the liner cannot be removed by inversion. The most common solution currently employed is to remove nearly all the water from within the interior 19 of the liner 11, and then to pull the liner out of the borehole 112 (e.g., using the tether 17). Doing so, however, frequently damages the liner 11 and prevents its reuse.

Figure 2:
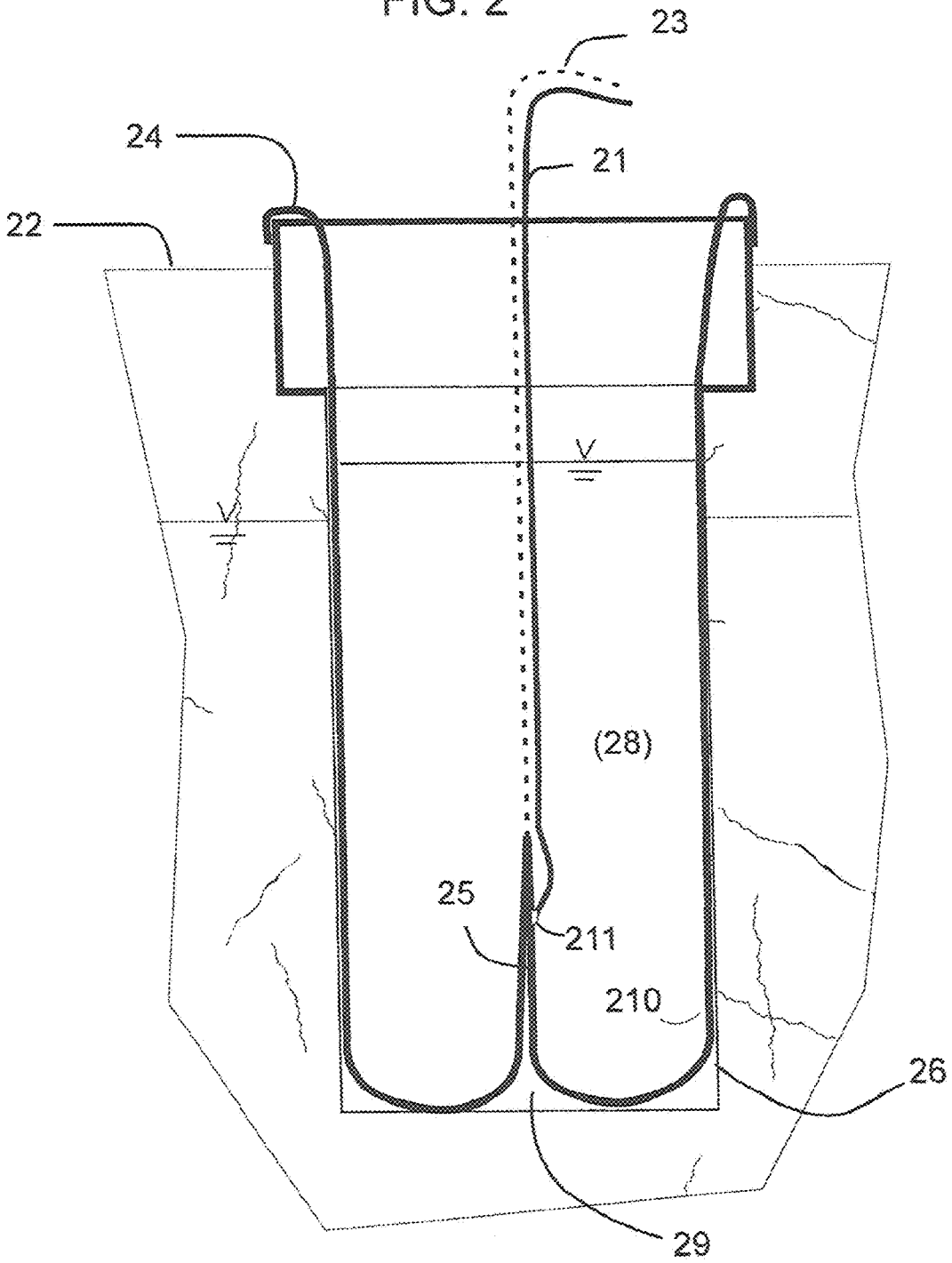
FIG. 2 is a side sectional view of a system according to the present invention, illustrating the presence of a vent tube extending to the surface and with the pump tube removed.

Attention is invited to FIG. 2. An aspect of the presently disclosed system and method is the extension of the vent tube 21 from the closed end of the liner, upwardly in the liner interior, all the way to above the ground's surface 22. The long vent tube 21 preferably is attached at least intermittently to the tether 23 for support. Such a vent tube configuration eliminates the need for a check valve (i.e., valve 18 in FIG. 1) for an air vent of the inverted liner 24. The long vent tube 21 also allows water to be added, via the tube and the port 211, to the exterior of the liner at the inverted portion 25 of the liner 24. (It is noted that the inverted portion 25 of the liner, adjacent the closed end, defines a void or pocket between liner walls, but that such void or pocket is topologically outside the liner; the inside or main interior 28 of the liner is substantially full of water as indicated in FIG. 2.) As a liner 24 is everted down a borehole, the inverted portion 25 thereof decreases in axial extent; conversely, as a liner is withdrawing up a borehole by inversion, the axial length of the inverted portion 25 increases until the liner emerges from the borehole at the surface 22. In FIG. 2, the liner is fully everted to the bottom of the borehole, so the inverted portion 25 of the liner is of relatively modest axial extent. Functional advantages of this system configuration will be described further hereafter. The present invention thus overcomes the known problem of needing to add water through a separate pump tube (tube 110 in FIG. 1), when it normally is impossible to re-install such a pump tube 110 back down into the borehole 26 (e.g., due to the presence of the inflated liner 24, and of disruptive fractures and breakouts in the borehole wall).

There thus is provided hereby a means and method (using a long vent tube and port) for adding water to the borehole 26 at a lower location beneath the closed end of the liner 24; such provision of water outside and below the liner allows an installed liner to be inverted to the surface 22. The liner 24 may be withdrawn (using the tether 23) upwardly in the borehole 26, toward or to the surface 22. The controlled addition, via the long tube 21, of water below the rising inversion point (i.e., at inverted closed end portion 25) of the liner reduces or prevents the liner from "pulling" a vacuum in the borehole volume below the liner (between its inversion point and the bottom 29 of the borehole). This is a significant advantage of the present system and method, because the bottom portions of a borehole 26 often exhibit low hydraulic conductivity, which impairs severely the water flow from the surrounding geologic formation into the borehole 26 near its bottom 29. Use of the disclosed system and method thus minimizes damage of the liner during inversion withdrawal from the borehole, permitting its reuse if desired.

It is an unexpected benefit that water can be added through the long vent tube 21, through the port 211, and into the borehole space below the inverting end of the liner, because the exterior pocket at the inverted portion 25 of the liner is believed normally to be firmly collapsed by the water pressure in the interior 28 of the liner 24. Before the present invention, it was commonly assumed that supplying water to the exterior of the inverted end portion 25 of the liner 24 would form a large water filled bladder (due to the pocket that generally exists at the end 25, as seen in FIG. 2), which bladder would press against the everted portion of the liner 210, and against the borehole 26 wall. Such a water-inflated bladder, it formerly was supposed, would tend to expand radially outward through the liner interior 28 and press firmly against a lower portion of the everted liner (and against the borehole wall), thus preventing the liner 24 from inverting with tension on the tether 23 to rise upward in the borehole. Such has been determined not to be the usual case, and the present system exploits this discovery.

Figure 3:
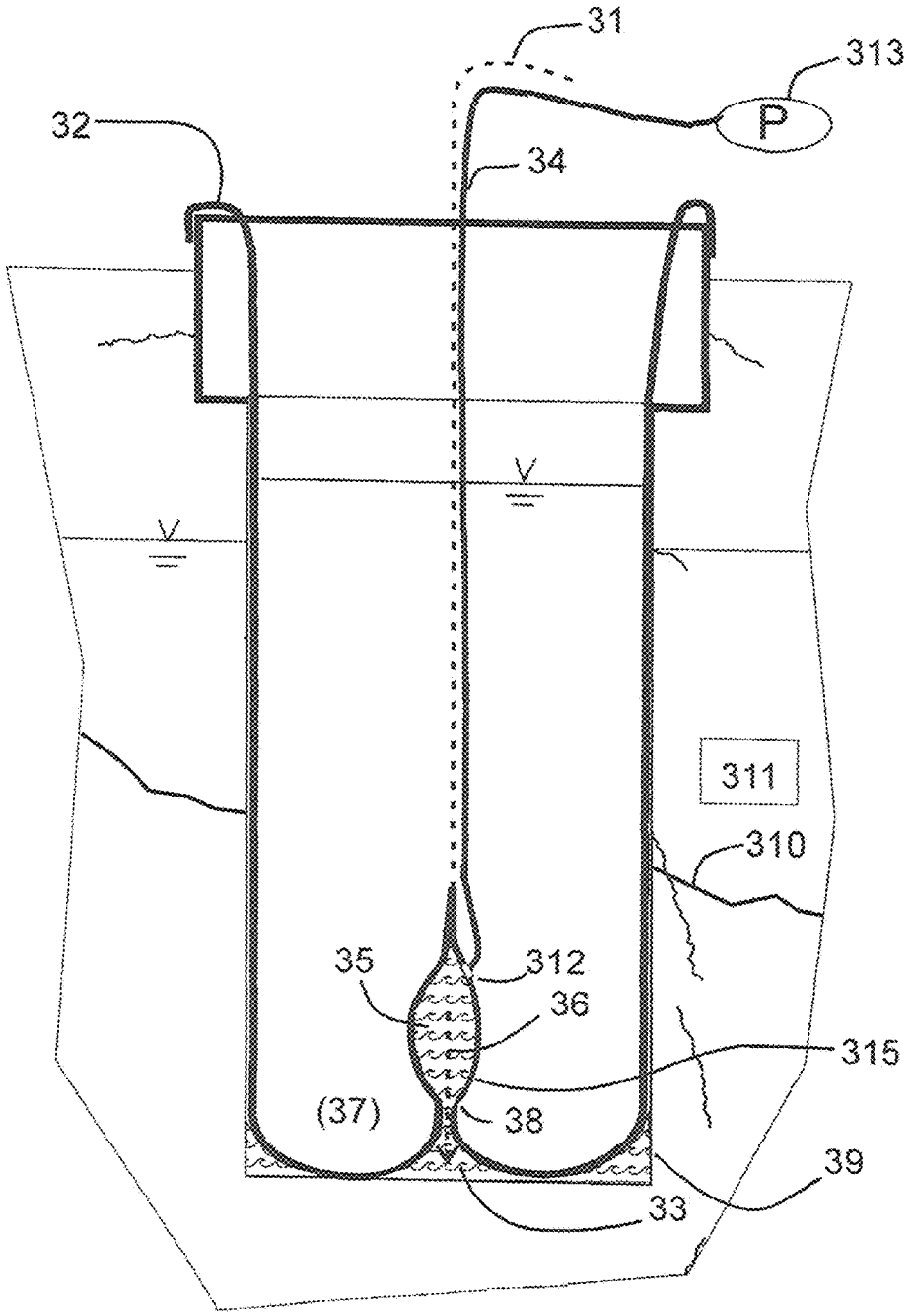
FIG. 3 is a side sectional view of a system according to the present invention, illustrating the addition of water to dilate the inverted portion of the inverting liner and to supply water beneath the liner.

FIG. 3 illustrates the actual water flow regime under a method of the present disclosure for inverting a previously installed liner. FIG. 3 depicts a fully everted liner 32 whose closed end is at or near the bottom of a borehole 39 in formation 311. It is desired to remove and extract the liner from the borehole by pulling on the tether 31 to invert the liner up the borehole. According to the present process, when tension is applied to the tether 31 (i.e., to invert the liner to withdraw the liner from the borehole 39), a low pressure is developed in the borehole volume 33 beneath the inverted end of the liner 32. The low pressure in this volume 33 usually prevents the liner 32 from inverting. Water is pumped with a pump 313, via the long vent tube 34, to the port 312 in the inverted end 315 of the liner. Water flows out the port 312 and into the small pocket or void 35 defined by and within the inverted end 315 of the liner, thus inflating the inverted end as seen in FIG. 3.

However, because the everted liner 32 contains wrinkles, there is a small flow path 36 (directional arrow in FIG. 3) available inside the inverted end 315 of the liner. The flow path 36 provides fluid communication from the void 35 to the low-pressure volume 33 beneath the bottom of the liner, with the result that the water added (via the port 312) to the void 35 in the inverted end 315 flows down toward the liner's point of inversion 38. The added water within void 35 is in pressure equilibrium with the water 37 within the interior of the everted liner 32, except that the comparatively lower pressure in the borehole volume 33 generates a pressure gradient in the interior wrinkles of the inverted end 315 (e.g., decreasing pressure along the flow path 36 from the void 35 and toward the borehole volume 33, past the point of eversion 38). The downward gradient toward the borehole volume 33 beneath the liner 32 (and outside the void 35) causes the water added via port 312 to flow downward out of the void 35, dilating the liner at and around the point of inversion 38, and thereby opening even more open vertical flow path. Thereby the water injected via the long tube 34 propagates toward and past the inverted bottom end 315 of the liner until it reaches the point of inversion 38 at the very bottom of the liner 32. At or about the point of inversion 38, the low pressure in the volume 33 beneath the liner causes the liner 32 to fully dilate, which constricts the aperture found at the inversion point between the void 35 and the volume 33. Such dilation and constriction would normally seal closed the bottom end of the inverted liner 32; it has been determined, however, that the existing wrinkles in the liner along the flow path 36 allow flow from the void 35 into the borehole volume 33 beneath the liner 32. This flow of added water is sufficient to permit the liner 32 to be further inverted from the borehole 39 by tether 31 tension. Adding the water to the volume 33 beneath the liner ameliorates or prevents the creation of such a low pressure in the volume as to prevent the liner from being inverted up the borehole.

The tension in the tether 31 nevertheless preferably is regulated to maintain a relatively low fluid pressure in the borehole volume 33 beneath the liner. If a low pressure (relative to the pressure within the liner interior 37) is not maintained in the volume 33, the water added to the void 35 (via the pump 313 and tube 34) may cause the pressure in the borehole and beneath the liner 32 to equilibrate with the pressure within the interior 37 of the everted portion of the liner 32. The loss of that pressure differential between the inside 37 of the liner and the borehole volume 33 beneath the liner may permit the liner 32 to collapse undesirably and to buckle, instead of inverting. Such collapse and buckling of the liner 32 can cause the liner to become firmly jammed in the borehole 39, preventing liner 32 removal. Therefore, it is advised in accordance with the method that the tether 31 tension is monitored by any suitable method, and controlled to maintain a low pressure in the borehole volume 33 (beneath the liner's rising point of inversion 38) relative to the pressure monitored within the liner interior 37. As long as such differential pressure is maintained, by tension applied through the tether 31, the constricted aperture at the point of inversion 38 at the bottom end of the inverted liner 315 constrains the flow of the added water from the void 35 into the borehole 39.

As the liner 32 is inverted during the controlled pumping of injected water into the long vent tube 34, the everted portion of the liner 32 can continue inverting. Inversion continues (the point of eversion moves upward in the borehole) to withdraw the liner 32 up the borehole, until the sealing liner 32 is removed from, and thus uncovers, a flowing fracture 310 in the formation 311. At that time, the water inflow from the formation 311 will increase the pressure beneath the liner 32, thus to slow the flow of the injected water along the flow path 36. It is preferable that, when significant inflow from a fracture 310 is realized, water injection through the long tube 34 then be stopped, but the tension on the tether 31 be maintained, to prevent a buckling of the liner 32. Because the first-encountered ambient water-bearing formation fracture 310 is seldom a high-volume water discharge path, the water added by injection from the pump 313 can be safely but controllably terminated or slowed to prevent the loss of the low pressure in the borehole volume 33 beneath the liner. A reliable indication that water addition is no longer needed is an increase in the rate of liner inversion and a reduction in the tension on the tether.

It is known by those in the art that the differential pressure beneath the bottom of an inverting liner is calculated by:

$$\Delta P=2(T-D)/A-P \text{ min},$$

where T is the tension on the tether, Pmin is the minimum eversion pressure for (inside) the liner, D is the drag of the tether and liner in the borehole, and A is the cross-sectional area of the borehole. For very stiff liner fabrics, Pmin is relatively large, and must be well overcome by the tether tension to prevent liner buckling. The drag is usually not significant for a tether and vent tube in the borehole. However, for slender boreholes (e.g., less than about four inches diameter), or boreholes which are not vertical, this drag can be significant.

Figure 4:
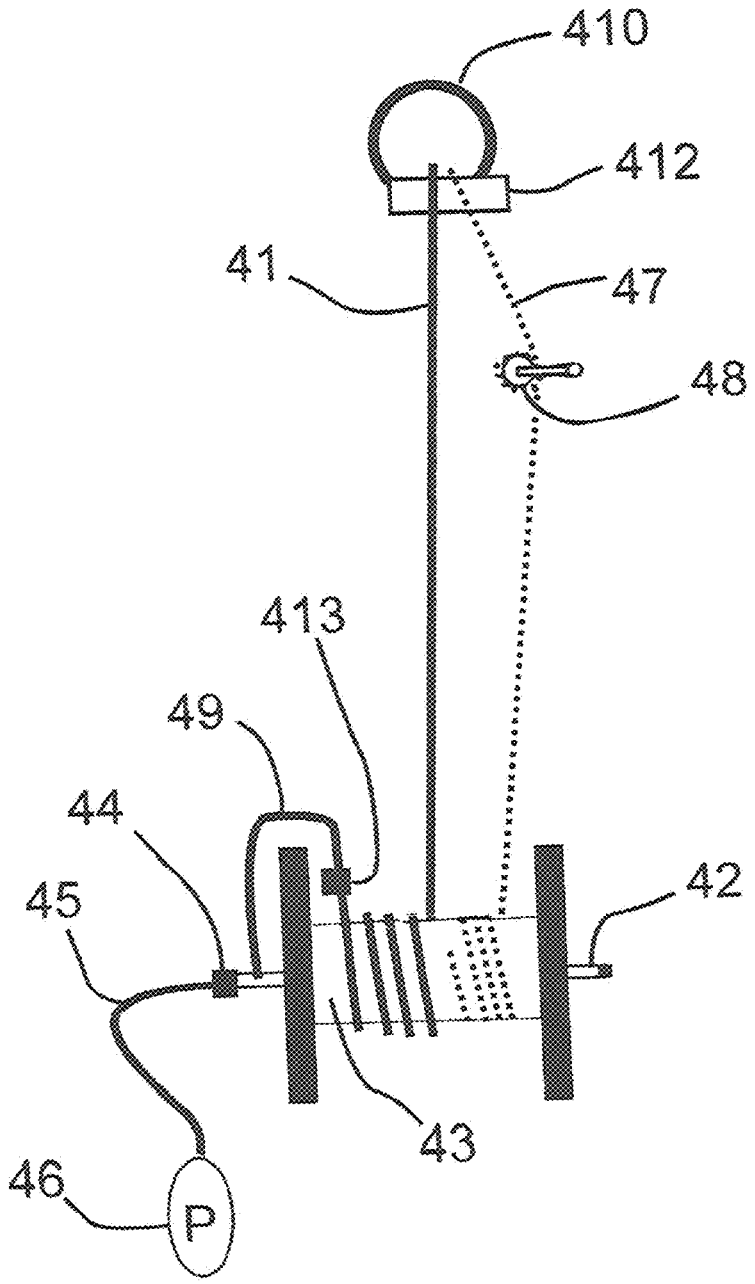
FIG. 4 is a diagrammatic top or plan view of a system and apparatus, according the present invention, for supporting a reel containing the tube, tether and liner and which allows water addition as the liner is being inverted from the borehole.

Adding water to the long vent tube 34 while the liner is being inverted from the borehole is awkward while tension is being applied to the tether 31 by a winch at the surface. The long vent tube 34 normally cannot be wrapped on the tether's take-up winch, and therefore must be separated from the tether as the liner rises from the borehole. An optional but desirable reel assembly is illustrated schematically in FIG. 4 for accumulating the tube 41 at the ground's surface as the tube emerges from the top of the borehole 410. (The liner being extracted by inversion is omitted from FIG. 4 for the sake of clarity of illustration.) Referring to FIG. 4, which is a top plan view of the system, a winch 48 operably engaged with the tether 47 is used to pull the liner and vent tube 41 from the borehole. As the vent tube 41 is withdrawn from the borehole 410, it is separated from the tether 47, passed over a roller 412, and directed to a larger simple main reel 43 on a reel stand at the surface. Pumping water down the vent tube 41, as it is being withdrawn and as the main reel 43 rotates, however, requires a special reel design.

Accordingly, there is provided a reel 43 having a hollow axle 42 through which water may flow. The open upper end of the vent tube 41 is in fluid communication with the reel's hollow axle 42 via a coupling 413 and auxiliary tube 49, which coupling and tube rotate with the reel 43 and axle 42. Water thus may flow, via the axle 42, between the inlet end swivel connection 44 and the coupling 413. As the tube 41 is being wound onto the main reel 43, water is injected into the inlet end 44 of the hollow axle 42 through a swivel connection 44 of known configuration. The inlet connection 44 is in fluid communication, using a water pump 46, with a delivery tube 45. Because the axle 42 rotates with the reel 43, the vent tubing 41 can be wound upon the reel 43 while water nevertheless continues to be added to the vent tube 41 via the auxiliary tube 49, which is connected to the interior of the hollow axle 42.

It is also convenient to wrap the tether 47 as it comes off the winch 48 onto the same main reel 43. Otherwise, there is a great tangle of tether 47 and tubing 41 accumulating at the surface. When the closed end of the inverted liner arrives at the surface, there is no longer a need to add water to the borehole 410 beneath the liner. In the normal liner removal, water addition can be halted after the first significant water-flowing formation fracture has been uncovered by the liner inversion. The liner may then be pulled from the borehole using any of several known methods and attachments. The liner may also be accumulated on the same reel 43 wrapped over the tubing 41 and tether 47. It is noteworthy that the inversion of a liner from beneath that deepest significant fracture allowing subsurface flow into the borehole may take many hours, even if the necessary inversion is only one-foot distance. In many situations, the inversion of a liner to the surface, without damaging the liner, is practically impossible without the forgoing apparatus and techniques. For very deep water tables, it may be difficult to control the water addition with a continuous operation of the pump 313. A more cautious procedure is to add water to the volume 35 in controlled increments and to allow the liner to invert a short distance with each addition before adding more water.

It is also possible, if desired, to use the foregoing described hollow axle reel 43 assembly to facilitate everting the liner down the borehole, by essentially reversing the process. The tether 47 is paid out from the reel 43 as the liner and vent tube 41 also are controllably unwound from the rotating reel and disposed down-hole; meantime, water is pumped by the pump 46, as needed, from the borehole beneath the eversion point of the liner via the vent tube 41, and thence via the coupling 413 and auxiliary tube 49, rotating hollow axle 42, and swivel connector 44. However, such water removal from the borehole beneath the liner requires another feature described hereafter. The hollow-axle reel assembly and associated tubing also can be used to draw trapped air, from the closed end of the liner, through the same vent tube and hollow axle assembly while the liner is being installed by eversion down-hole. This technique prevents even the temporary formation of an air balloon as occurs with the short valved vent tube. The water injection procedure according to this disclosure, however, significantly and especially facilitates water addition during liner inversion back up the borehole.

There has been disclosed, therefore, a system and method for performing a flexible liner inversion from a borehole in a subterranean geologic formation of low hydraulic conductivity. A tether is provided for withdrawing from the borehole a flexible liner that previously has been installed (i.e., by eversion) down the hole; the tether is connected to the closed end of the installed liner. The system includes a continuous vent tube connected to the interior of the inverted liner and extending along the length of the tether to the top of the borehole. The liner removal procedure with tether tension and associated water addition beneficially permits the removal of the flexible liner by inversion from the low-conductivity borehole. It is convenient that the same tube for water addition also may be used for air removal from the liner during liner installation by eversion. The system and method allow the pump tube to be removed after the liner installation, to preserve the sealing characteristic of the flexible liner.

It is contemplated that the method and apparatus may be practiced at any liner-sealed borehole location which otherwise requires the pump tube removal, and for which the liner is preferred to be removed by inversion instead of being dragged from the borehole after removing the eversion water from the liner interior. The presently disclosed methodology results in a large labor savings. Notably, in previously known systems, the entrapment of a flexible liner in a low permeability formation has resulted in liner removals requiring a period of several days, The presently disclosed method may be advantageously applied to techniques such as those of U.S. Pat. No. 7,896,578 ("Mapping of Contaminants in Geologic Formations"), which techniques benefit from the absence of a pump tube (e.g., pump tube 110 in FIG. 1, to pump water into the borehole volume below the inverted end of the liner). The elimination of a pump tube prevents flow that otherwise would occur in the borehole adjacent to the pump tube (and outside the liner), thus compromising the adsorption in the carbon felt of the apparatus of U.S. Pat. No. 7,896,578. The methods of U.S. Pat. No. 7,896,578 also benefit substantially from the inversion of the liner from the borehole, because a liner free of leaks often is needed to re-seal the borehole after the removal of the cover employed in that procedure.

The same long vent tube design of FIG. 2, can be modified and employed to allow a liner to be everted down a borehole into a formation of low conductivity or permeability, but without the use of the pump tube (e.g., tube 110 in FIG. 1). Ordinarily, if an attempt is made to remove water from beneath the everting liner (in a borehole extending through relatively impermeable strata) by pumping water from the long vent tube (such as tube 21 seen in FIG. 2), the water removal and associated reduction of the pressure in the long vent tube causes the inverted portion of the liner to collapse more tightly. This collapsing effect is due to the water pressure outside the inverted end portion of the liner (i.e., water pressure inside the liner but surrounding the liner inverted portion 25 in FIG. 2). This effect is the opposite of the dilation of the liner as discussed hereinabove with reference to FIG. 3, and can impede or prevent the flow of water from beneath the everting liner toward a port such as port 211 in FIG. 2. Such collapse normally could prevent the removal of water from beneath the descending, everting, liner using a long vent tube. (Such water removal is usually the purpose of the pump tube, such as tubes 110 and 34 seen in FIG. 1.)

Figure 5:
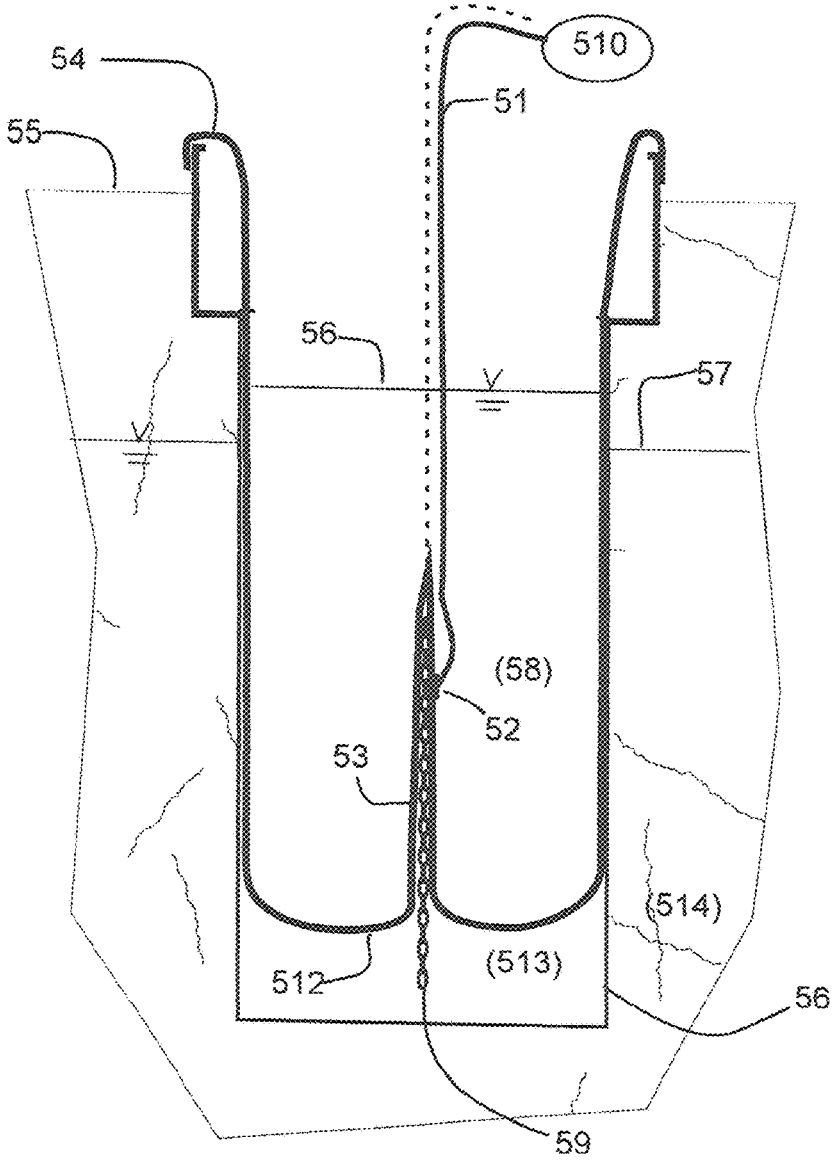
FIG. 5 is a side sectional view similar to FIG. 2, depicting the addition to the system of a permeable flexible conduit which allows water removal from beneath the everting liner during liner installation.

Reference to FIG. 5, however, illustrates that the system and method optionally may be modified, and utilized for liner eversion, by providing a suitable flexible conduit 59, descending beneath the port 52 and extending though the interior of the inverted portion of liner 53. A preferred version of the conduit 59 is described further hereinbelow. Water 513 can be withdrawn, via the conduit 59, from the volume space beneath the liner 54 as the liner is being everted down the borehole 50. The conduit 59 in effect "holds open" the pocket or void outside the liner defined by the inverted portion 53 thereof, so that water can flow upward through that void as the liner undergoes eversion. As the liner 54 is everting, the flexible conduit 59 constantly extends beyond the liner's eversion point 512 and toward the bottom of the borehole 50. The flexible conduit 59 thus allows water 513 beneath the everting bottom 512 of the liner 54 to flow upward, within the void outside of, and defined by, the walls of the inverted portion 53 of the liner, to the port 52. The port 52, through the liner and near the liner's closed end, permits water to be pumped from the pocket defined by the inverted portion 53 of the liner and into the long vent tube 51, and thus from beneath the descending liner. Such water removal can be effected easily with a pump 510, such as a peristaltic pump at the surface 55, and optionally but preferably through a hollow axle assembly and methodology similar to those disclosed hereinabove with reference to FIG. 4.

Water removal with a peristaltic pump requires that the water level 56 in the liner 54 be less than approximately twenty-five feet below the level 55 of the peristaltic pump. This constraint prevents a vacuum from forming in the long vent tube 51 and the associated cavitation which would inhibit water flow in the system. Because the liner water level 56 can be a substantial height distance above the water level 57 in the formation 514, the hydraulic head beneath the everting liner is typically increased substantially above the water table 57 in the formation. This is especially probable if the formation 514 below the everting liner is of relatively low permeability. In such a situation, the ability to remove water 513 from beneath the descending liner's eversion point 512 is most useful. If there are sufficient permeable geologic features (fractures or relatively permeable strata) intersecting the borehole 50, the length of the flexible conduit 59 need not be any longer than the depth of the borehole 50 below the last sufficiently permeable feature. Upon passing that permeable feature, the liner 54 seals that flow path, and it is essential that water 513 thereafter can be removed from beneath the liner to permit further descent of the everting liner.

Figure 6:
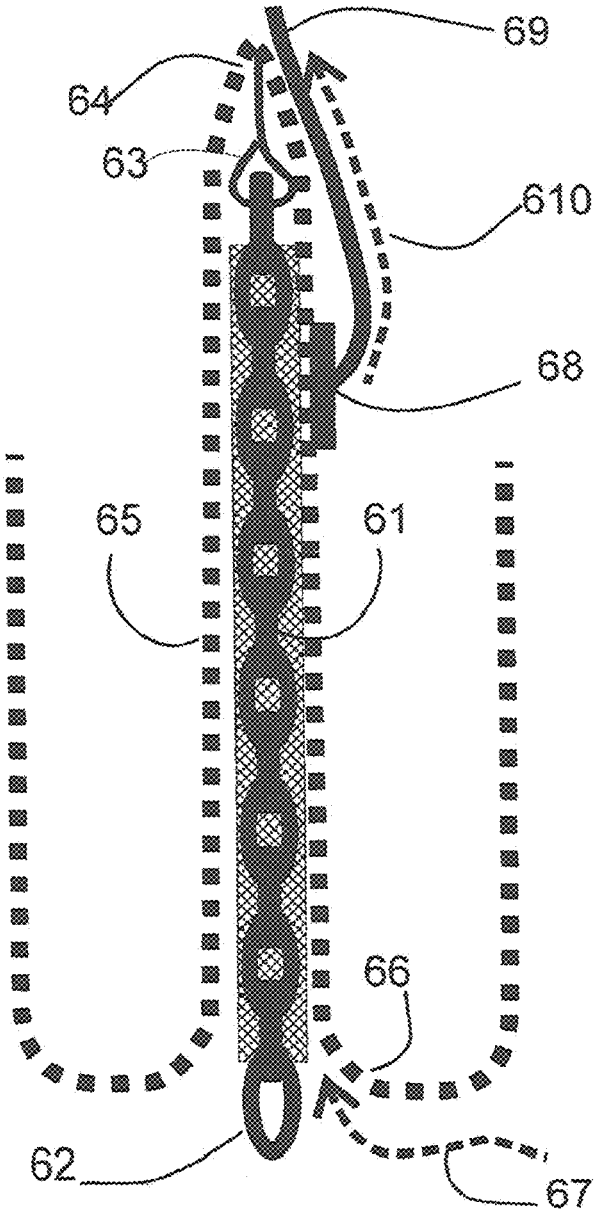
FIG. 6 is an enlarged vertical section view of selected features seen in FIG. 5, illustrating details of the permeable flexible conduit, effectively an extension of the long vent tube.

FIG. 6 shows the details of the flexible conduit 59 seen in FIG. 5. In a preferred but optional practice, the flexible conduit 61 is formed of a supported chain 62 covered with a permeable and flexible tubular mesh. The chain 62 is supported at its top end with a short connector tether 63 extending from the closed end 64 of the liner 66, thereby connecting the chain to the closed end of the liner. The conduit 61 is enclosed within the inverted portion 65 of the liner 66. The practice of the method thus includes extending the bottom end of the flexible conduit 61 into the borehole beneath the inverted portion 65. As the liner 66 is everting, the chain 62 is extended from the everting liner (FIG. 5), thereby maintaining an open flow path 67 from the space beneath the bottom, everting portion, of the liner to the port 68, thereafter to flow 610 through the long vent tube 69, and then to the pump at the surface.

Figure 7:
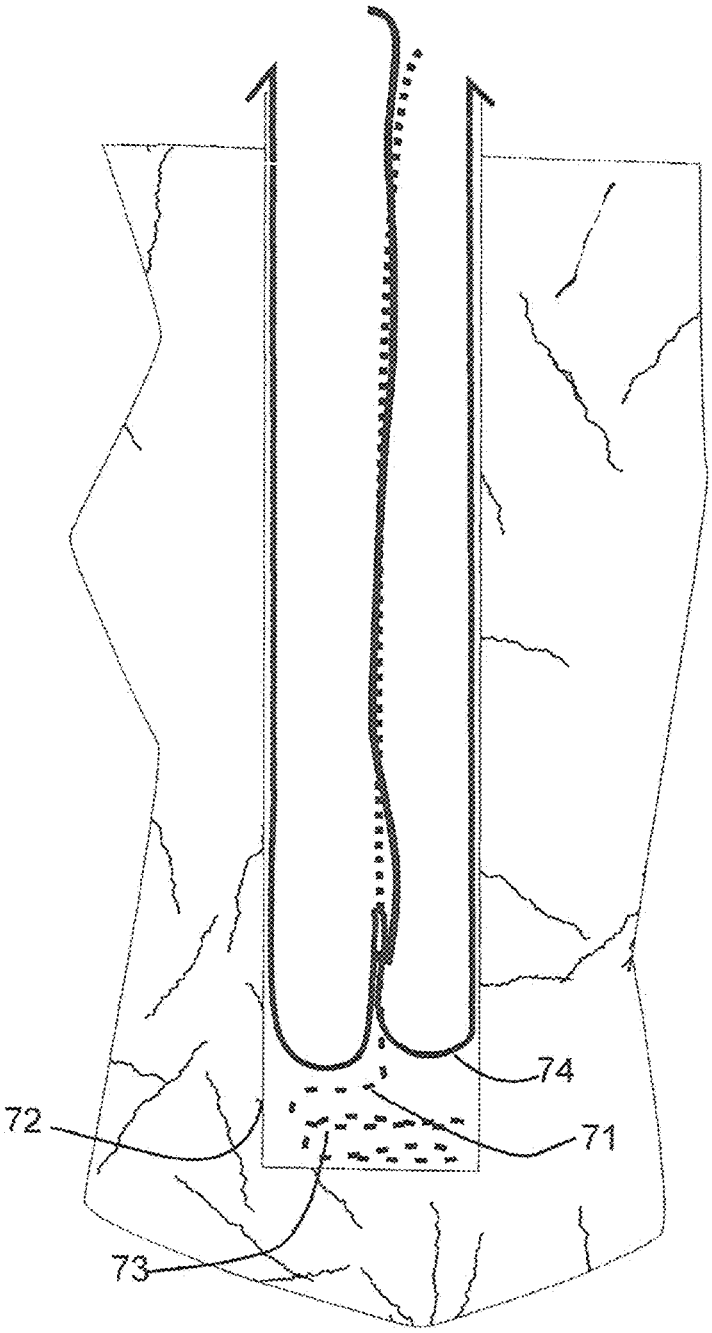
FIG. 7 is a side sectional view similar in context to FIG. 5, showing a permeable conduit accumulating in the bottom of the borehole during liner eversion.

Attention is turned to FIG. 7. When a conduit 61 comprised of chain 62 (as seen in FIG. 6) reaches the bottom of the borehole, such a conduit 71 accumulates as a pile 73 of chain links in the bottom 72 of the borehole (similar to the accumulation of an anchor chain in a chain locker on a sailboat). The liner 74 (liner 66 of FIG. 6) can evert onto the piled chain 73 without damage of the liner or tangling of the flexible conduit 71. An advantage of such an accumulation is that the chain is easily removed during the subsequent liner removal, by inversion, without kinking of the chain, and the conduit formed of chain and mesh rises into the inverting liner in the reverse of the installation. The surrounding mesh reduces any tendency of the chain links to kink or to nick the liner. Such kinking is normally prevented by a cross bar in each link of an "anchor" type chain. Referring also to FIG. 6, the chain conduit features an added advantage, during liner removal by inversion, in that an open flow path 610 is assured, during liner removal, for water injection via the long tube 69. Further, there is less reliance on wrinkles in the liner providing a flow path past the everting end of the liner.

If a user of the present system and method has foreknowledge of the extent of a permeable interval of the borehole, such knowledge as may be obtained by the methods and systems of U.S. Pat. No. 6,910,374 ("Borehole Conductivity Profiler") and U.S. Pat. No. 7,281,422 ("Method for Borehole Conductivity Profiling"), the chain length can be predetermined and selected to assure easy water removal below that level of a permeable feature in the borehole. The lower-most permeable feature intersecting the borehole is the feature of principal interest in this regard.

The ability to install a flexible liner without the need for a pump tube normally greatly reduces the time required for a liner installation, because the liner does not need to be deflated and re-inflated after the pump tube removal. An added advantage of the chain conduit is that a flow path is assured from the port to the bottom of the everting liner when the liner is covered with a thin hydrophobic covering as described, for example, in U.S. Pat. No. 7,896,578 ("Mapping of Contaminants in Geologic Formations"). Experience has shown that the flexible covering can impede the flow from the port through the inverted liner, as shown in FIG. 3 without the conduit addition.

Figure 8:
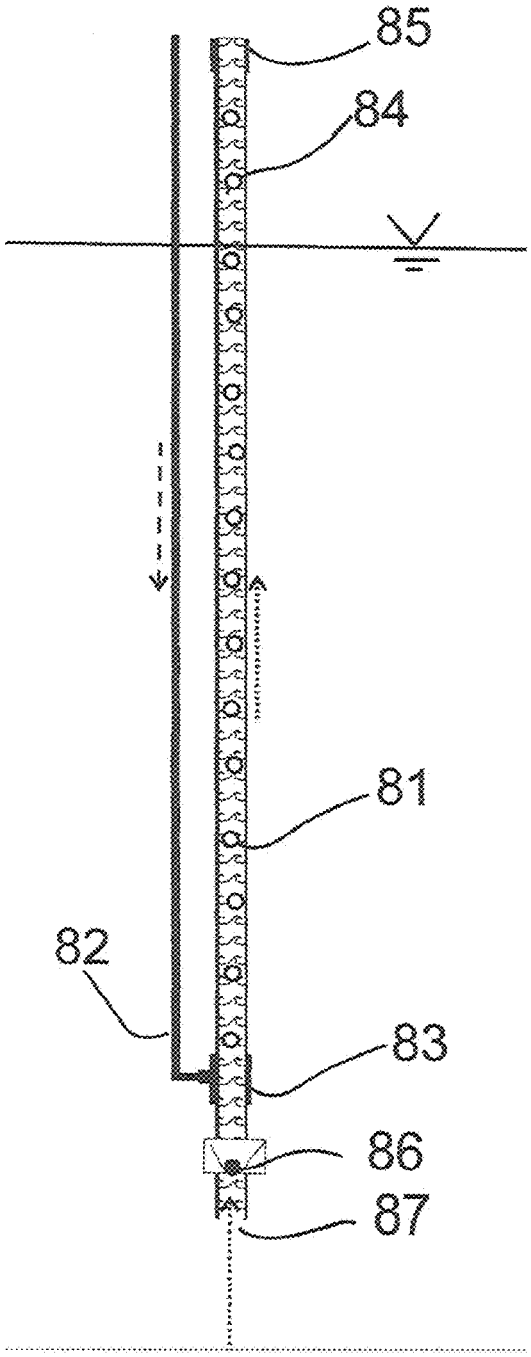
FIG. 8 is an enlarged vertical section view illustrating additional optional features of the long vent tube (as seen in FIGS. 2, 3 and 5) for beneficial use with deep water tables in a geologic formation.

In the situation where peristaltic pumping is insufficient for water removal during the installation of the liner by eversion, the long vent tube of FIG. 2 may be modified to provide a pumping capability by air-lift-pumping or by positive displacement pumping. FIG. 8 depicts schematically (in enlarged view, but not necessarily to scale within the figure) a substantial portion of the long vent tube 81 at some suitable elevation above the port (e.g., the port 52 on FIG. 5). A second, air injection, tube 82 is provided, extending from the surface and to a tee connector 83; the tee connector 83 is connected to both the air injection tube 82 and the vent tube, to place the air injection tube in fluid communication with the long vent tube 81. By injecting air from the surface down through the second tube 82 (dashed down-directional arrow in FIG. 8), the user can pump water upward in and from the long vent tube 81 by means of the common technique known as air lift pumping. (See upper dotted up-directional arrow in FIG. 8.) The air addition at the connector 83 reduces (by aeration) the density of the water column 84 in the long vent tube 81, causing the denser water (i.e., water 513 in FIG. 5) beneath the liner to displace the less dense aerated water 84 out the top 85 of the long vent tube 81 at the surface.

A second alternative pumping option, to promote liner eversion, is to locate a check valve 86 above the port 87 and below the tee 83, as shown in FIG. 8. In this latter case, by injecting air under a suitable high pressure into the top 85 of the long vent tube 81 (which tube initially is filled with ambient water) the check valve 86 closes under the increased applied pressure. With the valve 86 held closed by the pressure in the vent tube 81, and with continued injection of pressurized air into the vent tube 81, the ambient water 84 in the long vent tube 81 is expelled via the tee connector 83 and upward out of the second tube 82 at the surface. The pressure of the injected air at the top 85 is then controllably decreased, and the vent tube 81 refills with water from beneath the liner, via the now-open check valve 86 (see lower dotted up-directional arrow in FIG. 8) in preparation for another pumping stroke. After the vent tube 81 has refilled, the injected air pressure is again increased to repeat the process of closing the valve 86 and expelling water from the vent tube 81 to the surface via the second tube 82. The foregoing process can be recycled as many times as desired to evacuate water from beneath the liner. It also is noted by one skilled in the art, referring to FIG. 8, that if a user of the system is to use the long vent tube 81 for water addition (i.e., during inversion of the liner upward in the borehole), the system generally cannot include a built-in operable check valve (e.g., 86) in the vent tube 81. But as an alternative, the user can practice the basic system and method to add/inject water without a check valve, and then later "convert" the system to a check-valved water pumped-extraction configuration. This may be realized by pre-defining some type of valve seat, e.g., providing a constriction, at the appropriate height location in the vent tube (above the vent tube liner port, where valve 86 is seen in FIG. 8), and then dropping a suitably sized (non-floating) ball down the tube 81, from its top 85, and allowing the ball to fall and movably rest in the valve seat.

Figure 9:
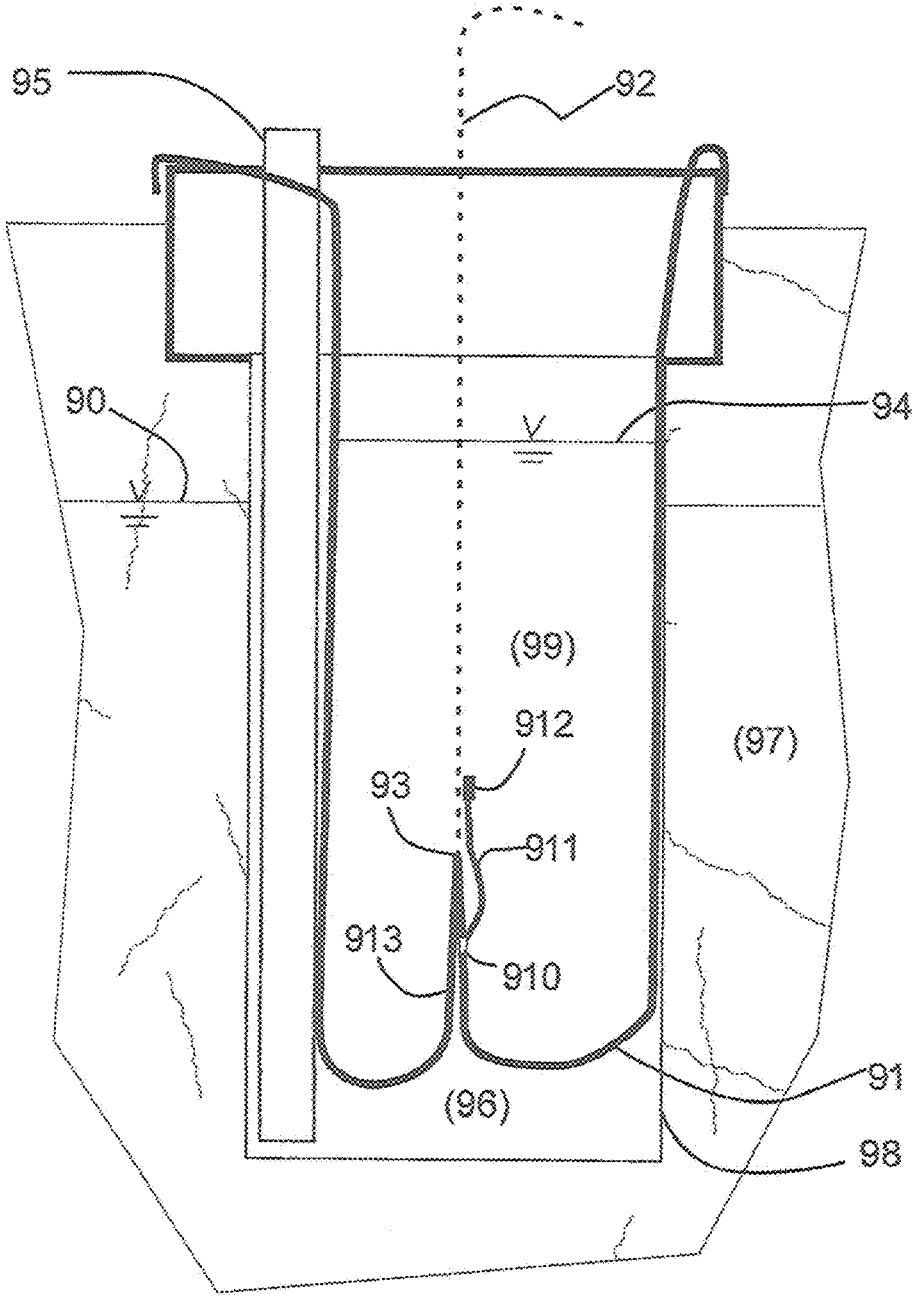
FIG. 9 is a side sectional view, similar to FIG. 2, of a of a liner being everted into a borehole with the use of a pump tube.
Figure 10:
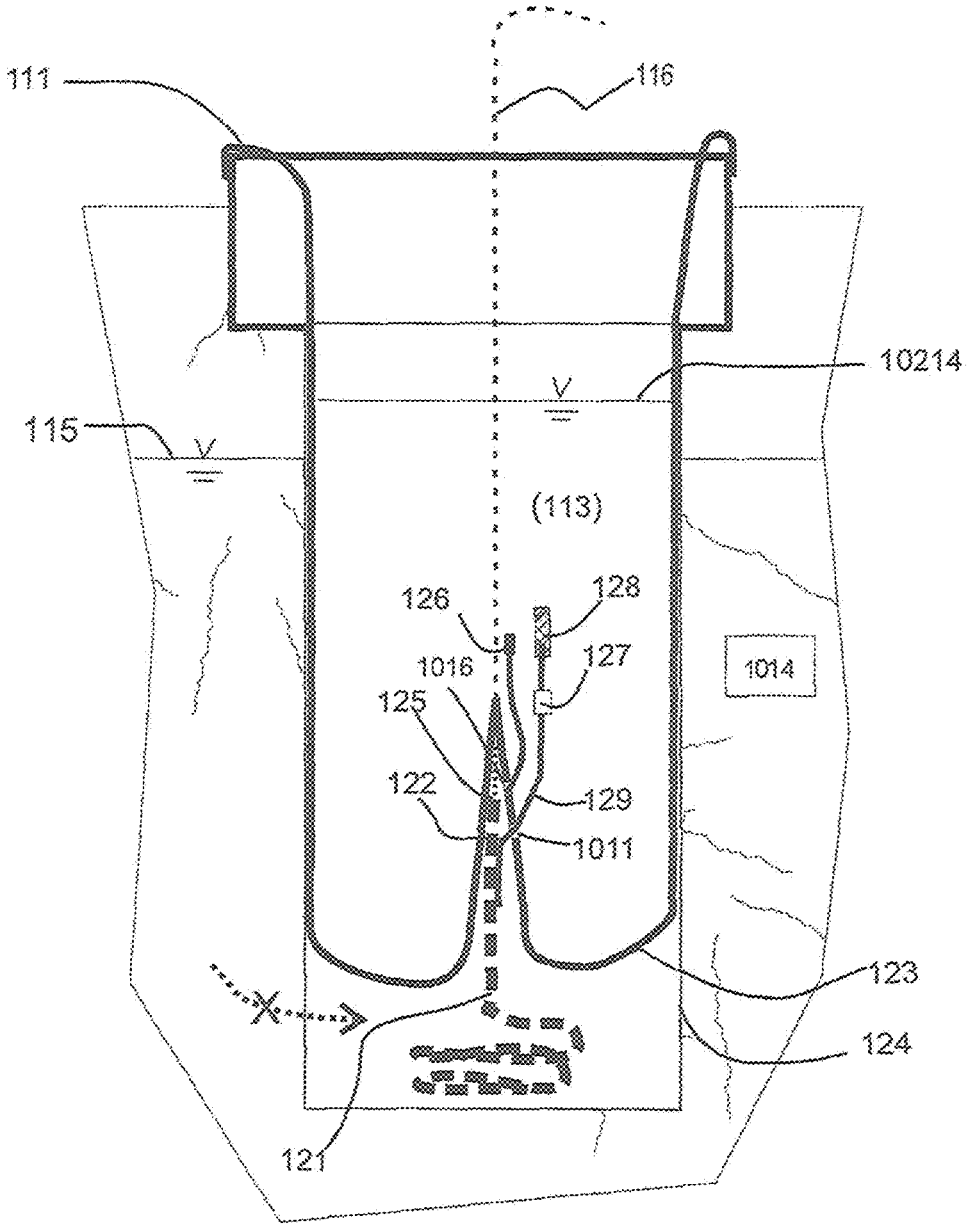
FIG. 10 is a side sectional view similar in context to FIG. 9, showing a beneficial alternative embodiment of the present system and method, illustrating a permeable flow conduit accumulating in the bottom of the borehole during liner eversion.
Figure 11:
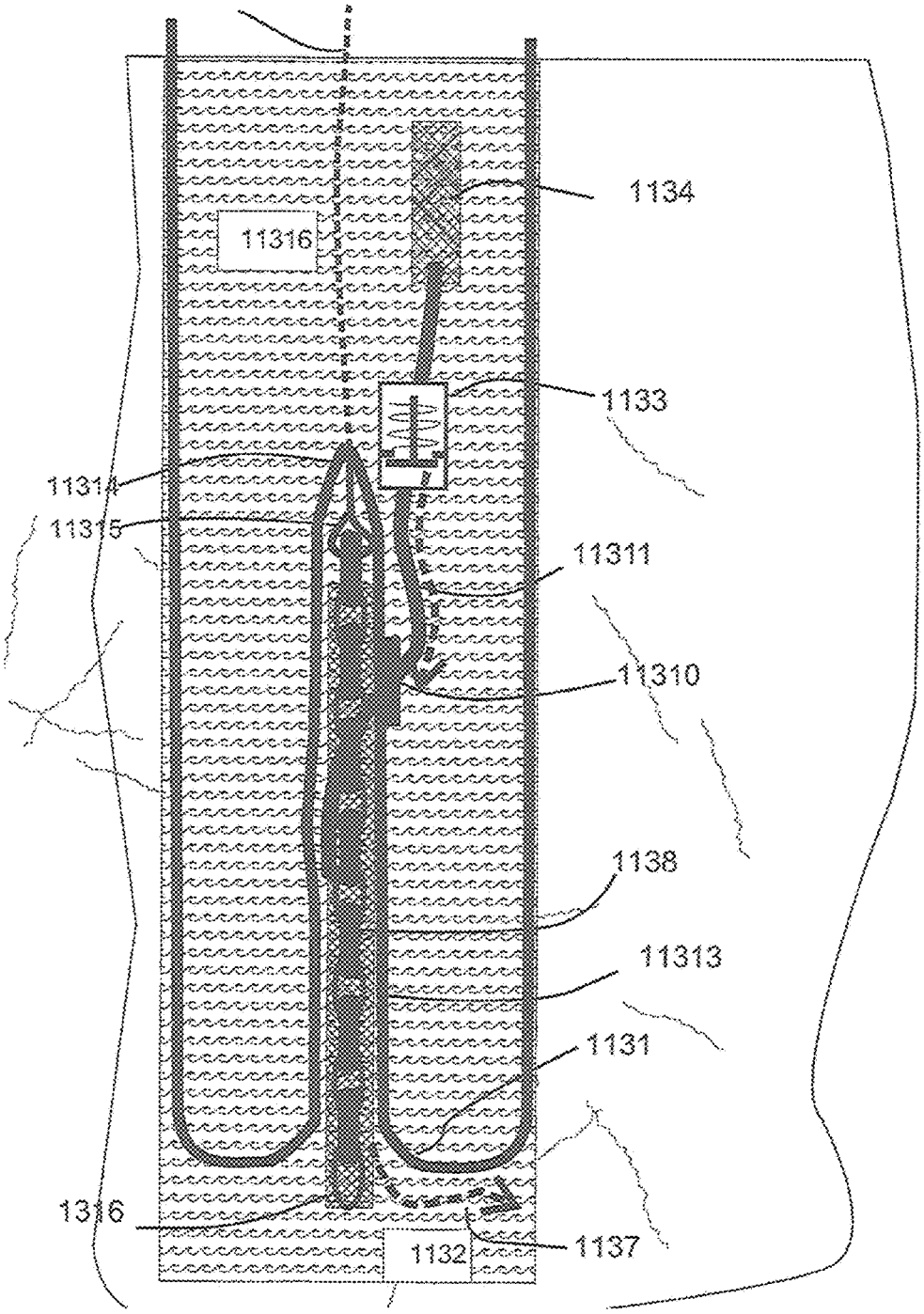
FIG. 11 is a side sectional view of the details of a pressure relief valve and filter useable in the embodiment of FIGS. 9 and 10, which allow water normally filling the liner interior to flow through the liner to a volume beneath the liner to foster simple inversion of the liner.

FIGS. 9-11 illustrate features of a method and system for liner eversion into and inversion from a borehole 98 having low transmissivity in the formation around the bottom portion of the borehole. The figures offer information further to an alternative embodiment of the system and method to promote rapid inversion of a liner to extract the liner from a borehole, but without the need for the long vent tubes 21, 34 seen in the embodiment of FIGS. 2-3.

Reference is invited to FIG. 9, which is very similar to FIG. 1. Again, the liner system typically includes a liner 91, and a tether 92 attached to the closed end 93 of the liner, the tether used to maintain tension on the liner 91 as it is installed by eversion down the borehole 98. The water addition into the open end of the liner 91 (above the top of the borehole) raises the water level 94 in the liner interior above the formation water level 90, thereby providing a pressure to the interior 99 of the liner 91 that drives the eversion process. The water level 94 creates a liner interior pressure during the practice of the invention. Like the system of FIG. 1, a pump tube 95 disposed outside the liner 91, between the liner and the borehole wall, allows borehole water in the bottom space 96 below the liner's eversion point to be withdrawn from beneath the liner 91 as it everts down the borehole. (Again, in the case in which the borehole water in space 96 cannot be displaced into the surrounding geologic formation 97 by the everting water filled liner 91.) Water from within the borehole is pumped from beneath the eversion point of the liner 91 as the liner everts down the borehole 98. The water withdrawal upward through the pump tube 95 can be done using a normal centrifugal pump for shallow ambient formation water depths 90, or a common air lift pumping system for deeper water levels 90 in the formation 97.

Also shown in FIG. 9 is a port 910 through the liner 91. The port 910 is connected to an air release tube 911 and a check valve 912, which tube and valve assembly allows air trapped in the inverted portion 913 of the liner 91 to escape into the interior 99 of the liner, thus avoiding or ameliorating dilation of the liner at its inverted portion 913 at the point of eversion. This configuration of air release tube 911 and check valve 912, at the inverted portion 913 are a normal feature of liners undergoing eversion.

During liner installation, after the everting liner 91 reaches the bottom of the borehole 98, some of the fill water in the liner is pumped from the interior 99 of the liner, causing it to partially collapse. The pump tube 95 is then withdrawn from the borehole 98. Water is again then added into the interior 99 of the liner 91, causing the liner water level 94 to rise, which in turn causes the liner 91 to dilate to form a complete seal of the borehole, as known in the art.

As known in the art, advantage of using an everting liner to seal boreholes is that the liner 91 can be retrieved or extracted, by inversion, from the borehole at a later time. However and as discussed previously, if the liner 91 is to be inverted without a pump tube 95 in place (e.g., the tube extending down the borehole to the space 96 beneath the bottom-most point of the liner), and if the formation 97 has a very low conductivity, the ambient water in the formation cannot flow into the borehole space 96 beneath the liner while the liner is inverted. That lack of formation water flow into the borehole space 96 beneath the liner can cause a partial vacuum to form in the borehole beneath the liner 91 as tension is increased on the tether 92. The embodiment of FIGS. 2-3 hereinabove utilizes a long tube (e.g., see tube 21 in FIG. 2 above) connected to the air release tube (i.e., tube 911 in FIG. 9), and extending to the ground's surface, in lieu of the check valve 912 seen in FIG. 9. The long tube 21 (or long vent tube 34 of FIG. 3) allows water to be added beneath the liner, to prevent the formation of a vacuum as described above. However, such liner removal, with water addition through the long tube, is complicated and ordinarily requires added skill and special equipment.

Continued reference is made to FIG. 9. It is known that the tension required on the tether 92 to invert a borehole liner 91 is estimated according to the equation: $T=\frac{1}{2}\Delta PA$, where T is the tension on the tether (transferred to the inverted liner), $\Delta P$ is the pressure difference between the liner interior pressure in the interior 99 of the liner (at the bottom end of the liner 91) and the borehole pressure in the lower borehole volume or space 96 beneath the liner, and A is the cross-sectional area of the borehole. Increasing the tension T on the tether 92 causes the $\Delta P$ to increase until a high reduction in pressure occurs beneath the liner in space 96. This high differential pressure is normally reduced by the water flowing into the space 96 from the adjacent formation 97. But if the conductivity of the formation 97 is too low to allow the water flow into the borehole space 96, even with the low borehole pressure beneath the liner 91, the low pressure beneath the liner will persist. If the tension on the tether 92 is nevertheless further increased, the pressure in the space 96 beneath the liner 11 may decrease until the liner is damaged (e.g., torn or ruptured at the closed end 93) by the extreme tension force on the tether 92 where it is connected to the liner.

A central aspect of the alternative system of FIGS. 9-11 is to allow water from the interior 99 of the liner 91 to flow to the space 96 beneath the liner, thereby raising the pressure in the unsealed borehole beneath the liner, and thus allowing the liner 91 to be further inverted upward. By allowing water to flow from the liner interior 99 to borehole volume beneath the liner, the need for a long vent tube, such as in FIG. 2, is avoided, and the associated complex assembly of hollow axle, reel, and pumping system (e.g., as seen in FIG. 4) may be eliminated.

FIG. 10 illustrates features of this alternative apparatus and method as modifications of the liner design features previously described. A chain 121 is connected to the inverted portion 122 of the liner 123. When the liner 123 is everted down into the borehole 24, the otherwise dangling chain 121 accumulates in a compact heap at the bottom of the borehole 124. When the liner 123 has everted down the borehole till it reaches the piled chain 121, the downward eversion is halted. Thereafter, the pump tube (e.g., tube 95 in FIG. 9) is withdrawn as described previously herein. The liner 123 is then refilled to liner water level 10214 to cause the liner to seal against the wall of the borehole 124. The borehole 124 thus is sealed, and whatever sampling, monitoring, etc., of the borehole environment may be undertaken as desired. Thereafter, during liner extraction with the tether 116, upward pulling on the tether 116 pulls up on the closed end of the liner, which also effectively pulls the top end of the chain 121 upward as well.

Components of this alternative system include the chain 121, and the connecting tube 129 sealably disposed through the connecting tube port 1011 in the liner 123. Fluid may flow through the connecting tube 129, but the port 1011 is sealed against leakage through the liner from outside the connecting tube. A pressure relief valve 127 is in line with the connecting tube 129 to regulate flow therethrough, and a filter 128 is situated at the upper terminus of the connecting tube in communication therewith. Filter 128 prevents debris within the liner interior 113 from entering into and interfering with the function of the relief valve 127. The pressure relief valve 127 is of a known type which opens automatically when a selected pressure differential across the valve is exceeded. Similarly, the pressure relief valve closes automatically when the pressure differential drops below the trigger of threshold value. When the differential threshold is exceeded, the valve 127 opens to permit water to flow (via the connecting tube 129) from the liner interior 113 to the borehole volume beneath the bottom of the liner 123. When the differential is less than the threshold, the valve 127 closes to prevent water from to flowing from the liner interior 113 to the lower borehole volume. The default condition of the valve 127 is closed; the valve remains closed until a triggering threshold pressure difference is exceeded, such as is caused by a pressure drop in the borehole water in the borehole volume beneath the liner 123.

There also is an air vent port 1016 defined through the liner 123 through which an air vent tube (like the tube 911 in FIG. 9) is disposed, the passage through the vent port 1016 being sealed to prevent water leakage outside the air vent tube and through the liner 91. An air vent check valve 126 at the upper end of the air vent tube allows air to escape from the interior of the vent tube (especially air that may accumulate in the pocket within the inverted portion 122 of the liner, such as during liner eversion), but prevents water from entering the air vent tube from within the interior 113 of the liner. Additional details of the system seen in FIG. 10 also are shown in FIG. 11.

Pulling upward on the tether 116 seen in FIG. 10 increases tension in the tether, and any resulting upward movement in the bottom (inversion point) of the liner 123 reduces the water pressure in the volume space 96 (FIG. 9) in the borehole beneath the liner 123. Such lower pressure, relative to the interior pressure head within the liner interior 113 due to the liner water level 10214, is communicated to the bottom end opening of the connecting tube 129 via the flow conduit provided by the interstitial spacing in the chain 121 within the inverted portion 125 of the liner. The lower pressure beneath the liner 123 is also communicated, via the air vent port 1016, to the air vent tube and on up toward the air vent check valve 126. The air vent check valve 126 prevents downward water flow through the air vent system. The connecting tube 129 communicates the lowered pressure to the relief valve 127, resulting in a threshold differential to be exceeded, which in turn causes the relief valve 127 to open, due to the increased pressure differential between the low pressure in the volume space beneath the liner 123 and the higher pressure attributable to the elevated head 10214 in the liner interior 113. The opening of the relief valve 127 allows water flow from the liner interior 113, through the tube 129 and port 1011, to the flow conduit provided and partially defined by the chain 121, and thereby to the space 96 (FIG. 9) beneath the liner 123. The filter 128 connected to the tube 129 above the relief valve 127 prevents particulates from exiting the liner interior via the connecting tube 129. Such particulates could interfere with function of the relief valve.

However, unrestrained flow of water from the interior 113 of the liner to beneath the liner would cause a loss of the excess head 10214 (of the interior liner pressure) above the formation head 115 (the formation pressure attributable to the ambient water in the formation 10114). Such a loss of the excess pressure head inside the liner would undesirably compromise the sealing function of the liner 123 (above its point of eversion) against the borehole wall. The actuation of the relief valve 127 accordingly must be adjusted to regulate the flow from inside the liner to beneath the liner, so that the pressure in the liner interior 113 is maintained sufficiently high (above the formation pressure) to maintain a good seal of the liner 123 against the wall of the borehole 124. Stated differently, the water loss from the interior 113 of the liner through the check valve 127 cannot act as a "leak" of the interior liner fluid needed to conserve the liner's sealing function. The elevated interior liner pressure (from interior water head 10214), relative to the formation pressure 115, is also needed to assure that the liner 123 will properly invert under the applied upward retrieval force on the tether 116, instead of simply buckling under the tether tension and becoming jammed in the borehole 124. The relief valve setting only allows flow to occur when the ΔP described above exceeds a prescribed, preselected threshold, level.

FIG. 11 illustrates further details of the relief valve system seen in FIG. 10 which limit the flow from the interior 11316 of the liner. The flow of water from the interior 11316 of the liner to beneath the liner's bottommost portion 1131 is controlled and regulated by the calculated adjustment of the pressure relief valve 1133 to open only when the pressure differential exceeds an appropriate preselected threshold value. When the difference between a higher liner pressure in the liner interior 11316 and a lower borehole pressure in the lower borehole volume 1132 is greater than the threshold value, the valve 1133 opens automatically. Conversely, when the difference between a higher liner pressure in the liner interior 11316 and a lower borehole pressure in the lower borehole volume 1132 drops below the threshold, the valve 1133 closes automatically. The relief valve 1133 is in fluid communication with the connecting tube 11311; the connecting tube penetrates through, in communication with, a relief port 11310 in the liner. Preferably a short segment of tube, such as an extension of the connecting tube 11311, is situated outside the interior 11316 of the liner, within the pocket defined by the inverted segment 11313 of the liner. The short segment of connecting tube within the liner is in fluid communication with the length of tube 11311 outside the liner, via the port 11310. The filter 1134 is provided at the upper terminus of the connecting tube 11311 to filter fluid flowing toward the valve 1133 from the upper opening of the connecting tube.

Also seen in FIG. 11 are the attachment of the tether 1135 to the inverted closed end 11314 of the liner, so to reach aboveground (e.g., to a reel or spooling device) via the liner interior 11316. A cord 11315 extends from the other side of the closed end 11314 of the liner, and is connected to the upper end of a chain 1138 to support the chain within the inverted segment 11313 of the liner. The chain 1138 is contained in, or surrounded circumferentially by, a water-permeable mesh surround 1316 to enhance the flow through the interstitial space of the chain 1138. The surround 1316 may be composed of a polymer mesh which permits water to flow there-through, while also offering the inverted segment 11313 of the liner protection against damage by the chain 1138. It is seen in FIG. 11, therefore, that the interstitial spaces of the links of the chain 1138, as optionally but preferably within the surround 1316, define and provide a flow conduit within the inverted segment 11313 of the liner, through which fluid (water) may flow.

An operation of the disclosed system and method, to permit inversion of the liner to retrieve it upwardly in the borehole may be succinctly described with combined reference to FIGS. 10 and 11. The air vent tube and check valve depicted in FIG. 10 are not illustrated in FIG. 11, as they are a commonly known feature of everting borehole liners. As seen particularly in FIG. 11, the pressure in the lower borehole volume 1132 beneath the liner bottom portion 1131 is reduced by pulling upward on the tether 1135 and the resulting inversion of the liner. This reduced pressure is communicated from the lower borehole volume 1132 to the relief valve 1133 via the flow conduit of chain 1138, and the connecting tube 11311 through the relief 11310. The first portion of the flow path is provided by the conduit of the chain 1138 (which accumulates in the lower borehole volume 1132 at and above the bottom of the borehole). As the liner is inverted up the borehole, the chain 1138 rises with it and back into the "pocket" of the inverted portion 11313 of the inverting liner. The interstices of the chain 1138 thereby maintain, during liner inversion, a flow conduit from the expanding lower borehole volume 1132 to the short portion of the connecting tube 11311 that is adjacent to the chain 1138 within the pocket of inverted segment 11313 of the liner. The reduced fluid pressure in the interstices of the chain 1138 thus is communicated through the short portion of the tube 11311 to the relief port 11310 through the liner, which port connects to the connecting tube 11311 to the bottom of the relief valve 1133. The low fluid pressure in the chain 1138, and in the tube 11311, causes the relief valve 1133 to open if the pressure differential ΔP exceeds the threshold setting of the relief valve 1133. As a result, the tension in the tether 1135 must exceed that causing a specific differential pressure between the liner interior 11316 and the lower borehole volume 1132. If that differential pressure is greater than the relief valve setting, water flows from liner interior 11316 to the volume 1132 beneath the liner; such relief flow 1137 is indicated by directional arrows in FIG. 11, to increase pressure in the lower borehole volume 1132 thereby to allow inversion of the liner up the borehole. An advantage is that the users may control the water flow 1137 from inside the liner by adjusting the tension on the tether 1135. Relaxing the tether tension will cause the flow from inside the liner to cease, as the relief valve 1133 closes due to the rising pressure in the lower borehole volume 1132 beneath the liner bottom portion 1131.

Continued reference is made particularly to FIG. 11. The filter 1134 disposed above the relief valve 1133 assures that the relief valve can fully close when that differential pressure, ΔP, drops below the set pressure of the valve 1133. The filter 1134 assures that no extraneous particulate matter in the water within liner interior 11316 impedes the valve closure. A minimum differential pressure ΔP is required to cause the liner to invert under the tether tension. Rapid water flow from the surrounding geologic formation, when a sufficient flow path is uncovered by the liner inversion, can reduce the differential pressure to less than that needed to cause the liner to invert. Accordingly, the closure of the valve 1133 below a predetermined and preset differential pressure, is preferred to keep the liner inflated.

With the chain flow conduit to maintain the fluid communication between the relief valve 1133 and low pressure in the lower borehole volume 1132 beneath an inverting liner, the water in the liner interior 11316 can flow to beneath the liner whenever the tension on the tether is high enough to drop the pressure beneath the liner to a level to cause the valve to open. The net effect of this method and system is to allow the liner to be inverted from an impermeable borehole by simply applying a sufficient but controlled tension to the tether 1135, causing the liner to invert as the water flows from the interior 11316 of the liner. So long as the interior pressure of the liner is above the relief valve setting, the liner provides a sufficient ongoing seal of the borehole during inversion.

The length of the chain 1138 depends on two parameters. One parameter is that the chain 1138 need not be longer than half the borehole length (depth). This first parameter is because if the liner is inverted more than half the borehole length, the valve assembly (e.g., valve 1133 and filter 1134 in FIG. 11) reaches the surface of the ground, and is above the water level (94 in FIG. 9) in the liner, so water flow is not possible through the valve. However, the relief valve can still allow air flow to reduce the vacuum that may be forming beneath the inverting liner. Also, by way of additional parameter, if it is known that the geologic formation is permeable up to a distance L above the bottom of the borehole, the chain need be no longer than the length L. This is because an inversion of the liner above the permeable zone will allow water to flow from the formation to beneath the inverting liner, thus reducing the differential pressure $\Delta P$ for further inversion of the liner. In such case, the relief valve can seal to prevent excessive loss of the liner water fill.

It is contemplated that the invention may be practiced at any liner-sealed borehole situation which otherwise requires the pump tube removal, and for which the liner is preferred to be removed by inversion instead of being dragged from the borehole after removing the eversion water from the liner interior. This alternative system and method of FIGS. 9-11 thus results in a beneficial simplification and improvement of the method and system of U.S. patent application Ser. No. 15/190,010, and FIGS. 2-7 hereinabove. The ability to remove the liner using a relief valve therefore has an overall advantage.

Also noteworthy is that this alternative embodiment may be used in conjunction with methods such as those of U.S. Pat. No. 7,896,578 ("Mapping of Contaminants in Geologic Formations"), which benefit from the removal of a pump tube (to pump water into the borehole volume below the inverted end of the liner). The elimination of a pump tube prevents flow that otherwise would occur in the borehole adjacent to the pump tube (and outside the liner), thus compromising the adsorption in the carbon felt.

As mentioned previously concerning other embodiments, if a user of the present system and method has foreknowledge of the extent of a permeable interval of the borehole—such knowledge as may be obtained by the methods and systems of U.S. Pat. No. 6,910,374 ("Borehole Conductivity Profiler") and U.S. Pat. No. 7,281,422 ("Method for Borehole Conductivity Profiling")—the chain length can be predetermined and selected to assure easy water transfer from the liner to below the liner when the bottom end of the liner is below that level of a permeable feature in the borehole. The lower-most permeable feature intersecting the borehole is the feature of principal interest to be located.

The foregoing examples are offered to provide those of ordinary skill in the art with a further disclosure and description of how the compositions, articles, devices and/or methods claimed herein are made and evaluated, and are intended to be purely exemplary and are not intended to limit the scope of the methods and systems. While the methods and systems have been described in connection with preferred embodiments and specific examples, it is not intended that the scope be limited to the particular embodiments set forth, as the embodiments herein are intended in all respects to be illustrative rather than restrictive.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that an order be inferred, in any respect. This is true for any possible non-express basis for interpretation, including: matters of logic with respect to arrangement of steps or operational flow; plain meaning derived from grammatical organization or punctuation; the number or type of embodiments described in the specification.

Various patents and patent applications are referenced hereinabove. The disclosures of these publications in their entireties are hereby incorporated by reference into this application.

It will be apparent to those skilled in the art that various modifications and variations can be made without departing from the scope or spirit of the disclosed invention. Other embodiments will be apparent to those skilled in the art from consideration of the specification and practice disclosed herein. It is intended that the specification and examples be considered as exemplary only, with the scope of the invention being defined by the claims appended hereto.

I claim:

1. A method for facilitating removal of a flexible liner from a borehole below the surface of the ground, there being a lower borehole volume, with a borehole pressure therein, beneath a bottom portion of the liner, the method comprising:

disposing a flexible liner in the borehole, the liner having:
- a closed end; and
- a liner interior containing fluid creating a liner pressure, there being a variable pressure differential between the borehole pressure and the liner pressure;

disposing a port through the liner near the closed end;

extending a tube into the liner interior from the port;

regulating, with a pressure relief valve, fluid flow through the tube, the relief valve opening automatically when the pressure differential exceeds a threshold;

extending a tether from the closed end to the surface, for pulling the liner toward the surface;

pulling upward on the tether, thereby reducing the borehole pressure and increasing the differential pressure above the threshold; and allowing the pressure relief valve to open to permit fluid flow from the liner interior through the port toward the lower borehole volume.

2. The method of claim 1 wherein the relief valve opening when the pressure differential exceeds a threshold comprises the liner pressure exceeding the borehole pressure by a selected amount.

3. The method of claim 1 wherein regulating with a pressure relief valve further comprises the relief valve closing automatically when the pressure differential drops below the threshold.

4. The method of claim 1 further comprising filtering fluid flowing toward the relief valve from an upper opening of the tube, thereby preventing debris within the liner interior from entering the relief valve.

5. The method of claim 1 wherein pulling upward on the tether further comprises inverting the liner up the borehole.

6. The method of claim 5 further comprising controlling the fluid flow from the liner interior by adjusting a tension in the tether.

7. The method of claim 6 wherein adjusting a tension comprises relaxing the tether tension to cause the flow from the liner interior to cease when the relief valve closes due to a rising borehole pressure.

8. The method of claim 7 further comprising regulating the flow from inside the liner to maintain the liner pressure above a formation fluid pressure.

9. The method of claim 1 wherein the flexible liner has an inverted segment adjacent the closed end, and further comprising:

defining a pocket outside the liner and within the inverted segment; and providing within the pocket a flow conduit between the port and the lower borehole volume.

10. The method of claim 9 wherein providing a flow conduit comprises supporting a chain within the pocket.

11. The method of claim 10 further comprising containing circumferentially the chain with a water permeable surround.

12. A system for facilitating the removal of a flexible liner from a borehole below the surface of the ground, there being a lower borehole volume, with a borehole pressure, beneath a bottom portion of the liner, the system comprising:

a flexible liner disposed in the borehole, the liner having: a closed end; and a liner interior containing fluid creating a liner pressure, there being a variable pressure differential between the borehole pressure and the liner pressure;

a port disposed through the liner near the closed end;

a tube extending into the liner interior from the port;

a pressure relief valve on the tube to regulate fluid flow therethrough, the relief valve opening automatically when the pressure differential exceeds a threshold;

a tether, extending from the closed end to the surface, for pulling the liner toward the surface;

wherein when an upward pulling on the tether reduces the borehole pressure to increase the differential pressure above the threshold, the pressure relief valve opens to permit fluid flow from the liner interior through the port toward the lower borehole volume.

13. The system of claim 12 wherein the relief valve opens when the liner pressure exceeds the borehole pressure by a selected amount.

14. The system of claim 12 wherein the relief valve closes automatically when the pressure differential drops below the threshold.

15. The system of claim 12 further comprising a filter, on the tube, for filtering fluid flowing toward the relief valve from an upper opening of the tube.

16. The system of claim 12 wherein the tether is pullable upward to invert the liner up the borehole.

17. The system of claim 16 wherein tension in the tether is adjustable to control the fluid flow from the liner interior.

18. The system of claim 17 wherein the tether tension is relaxable to cause the flow from the liner interior to cease when the relief valve closes.

19. The system of claim 18 wherein the closing of the valve maintains the liner pressure above a formation fluid pressure.

20. The system of claim 12 wherein the flexible liner further comprises an inverted segment adjacent the closed end, and the system further comprising:

a pocket outside the liner and within the inverted segment; and a flow conduit in the pocket between the port and the lower borehole volume.

21. The system of claim 20 wherein the flow conduit comprises a chain supported within the pocket.

22. The system of claim 21 further comprising a water permeable surround containing circumferentially the chain.

* * * * *